US007748597B2

(12) United States Patent
Nicolai et al.

(10) Patent No.: US 7,748,597 B2
(45) Date of Patent: Jul. 6, 2010

(54) DEVICE FOR PRODUCTION OF A TUBE

(75) Inventors: Franz Nicolai, Mülheim (DE); Bernhard Heimann, Moers (DE)

(73) Assignee: SMS Meer GmbH, Monchengladbach (DE)

( * ) Notice: Subject to any disclaimer, the term of this patent is extended or adjusted under 35 U.S.C. 154(b) by 650 days.

(21) Appl. No.: 10/494,413

(22) PCT Filed: Oct. 18, 2002

(86) PCT No.: PCT/EP02/11665

§ 371 (c)(1),
(2), (4) Date: Apr. 27, 2004

(87) PCT Pub. No.: WO03/045601

PCT Pub. Date: Jun. 5, 2003

(65) Prior Publication Data

US 2005/0082345 A1 Apr. 21, 2005

(30) Foreign Application Priority Data

Oct. 27, 2001 (DE) ..... 101 53 144

(51) Int. Cl.
*B21D 39/00* (2006.01)

(52) U.S. Cl. ..... 228/151; 228/17; 228/17.5; 228/173.4; 228/144; 72/31.04; 72/48; 72/51; 72/370.26; 72/367.1

(58) Field of Classification Search ..... 228/17, 228/17.5, 144, 151, 173.4; 72/367.1, 368, 72/369, 370.26, 31.04, 48, 51, 52
See application file for complete search history.

(56) References Cited

U.S. PATENT DOCUMENTS

| | | | | |
|---|---|---|---|---|
| 3,636,903 | A * | 1/1972 | Anderson et al. | 72/52 |
| 3,648,007 | A | 3/1972 | Oppermann | 219/59 |
| 4,310,740 | A * | 1/1982 | Nakazima | 219/61.11 |
| 4,697,446 | A * | 10/1987 | Yamamoto et al. | 72/178 |
| 5,309,746 | A * | 5/1994 | Abbey, III | 72/8.3 |
| 5,423,201 | A * | 6/1995 | Steinmair et al. | 72/225 |
| 5,802,903 | A * | 9/1998 | Nakajima | 72/224 |
| 5,868,299 | A * | 2/1999 | Abbey, III | 228/147 |

FOREIGN PATENT DOCUMENTS

| | | |
|---|---|---|
| DE | 1289814 | 4/1964 |

(Continued)

*Primary Examiner*—Roy King
*Assistant Examiner*—Michael Aboagye
(74) *Attorney, Agent, or Firm*—Andrew Wilford

(57) ABSTRACT

The invention relates to a device (1) for production of a tube (2) with a polygonal, preferably rectangular cross-section, comprising a tube welding unit (3), in which the tube (2) is formed from a sheet metal strip and welded at the resulting jointing position and a rolling unit (4), connected to the tube welding unit (3) in the transport direction (R) of the tube (2), which essentially rolls the tube (2) into the desired polygonal cross-sectional contour. According to the invention, right-angled tubes may be produced with the optimal geometry, whereby a camber rolling unit (5) is arranged in series with the rolling unit (4) in the transport direction (R) of the tube (2), by means of which at least two opposing tube sides (6, 7) may be rolled with a pair of crowned convex rollers (8, 9).

15 Claims, 4 Drawing Sheets

FOREIGN PATENT DOCUMENTS

| | | | |
|---|---|---|---|
| DE | 1923241 | | 11/1970 |
| DE | 3212365 | | 10/1983 |
| FR | 1 450 279 | | 7/1966 |
| GB | 878 713 | | 10/1961 |
| GB | 878713 | * | 10/1961 |
| GB | 2222541 A | * | 3/1990 |

* cited by examiner

DEVICE FOR PRODUCTION OF A TUBE

CROSS REFERENCE TO RELATED APPLICATIONS

This application is the US national phase of PCT application PCT/EP2002/011665, filed 18 Oct. 2002, published 5 Jun. 2003 as WO 2003/045601, and claiming the priority of German patent application 10153144.3 itself filed 27 Oct. 2001, whose entire disclosures are herewith incorporated by reference.

FIELD OF THE INVENTION

The invention relates to an apparatus] for producing a tube having a polygonal shaped cross section, preferably a rectangular cross section, which has a tube-welding unit in which the tube is formed from a flat metal strip and the flat metal strip is welded at the seam, as well as a rolling unit following the tube-welding unit in the feed direction of the tube which rolls the tube to substantially the desired polygonal shaped contour in cross section.

Apparatuses of this type for producing a longitudinally seamed tube are known. German published application DE-AS 12 89 814 describes how a tube is formed from a metal strip which is fed to a tube-welding device. For finishing the tube, the tubular shaped metal strip is welded at the seam location. In German open application DE-OS 19 23 241 (U.S. Pat. No. 3,648,007) and in German Patent DE 32 12 365 C2 the structural details as to the configurations of the rollers required for rolling the tube following welding as well as for the control of the welding beam are given.

From the welding, the still circularly shaped tube, in cross section, can be shaped in a subsequent rolling process into a tube with a rectangular cross section. For that purpose, correspondingly shaped roll pairs act upon the tube; as a rule, the roll pairs are disposed one behind the other in the feed direction of the tube and a sizing mill frame is provided downstream of them. The goal is to thereby so form the tube that it ideally assumes the desired contour, for example the rectangular shape.

So that the welded tube, which develops as a result of the reshaping and welding process significant stress, will be straight along its longitudinal axis, a subsequent straightening process is also required in which the straightening of the tube is brought about by "straight bending".

Especially in the production of rectangular tubes, it has been found to be a problem that the tube material, because of its internal stresses has the tendency to bulge outwardly so that the desire rectangular contour may not develop. Rather, the sides of the rectangle and especially the longer sides are at least minimally bulged convexly outwardly which is a significant shape deviation by comparison with the desire contour.

OBJECT OF THE INVENTION

It is the object of, the invention to so improve an apparatus of the type described at the outset that the described drawbacks are eliminated.

The attainment of this object is achieved in accordance with the invention in that the rolling unit in the direction of advance of the tube has a convex or camber] rolling unit located downstream of it with at least one pair of crowned convex rolls acting upon at least two opposite tube sides, so-called "barrel" rolls.

To the extent that the invention counteracts the tendency of the tube sides to bulge outwardly, the polygonal tube, especially the rectangular tube, can be considered to be sized or calibrated with the convex barrel-shaped rolls. The target of this approach is to roll the tube sides with such concavities that the concavities themselves counteract the tendency in the tube for outward bulging of the tube sides so that overall a tube with an ideal polygonal cross section and especially a rectangular cross section will result. In an advantageous manner, the finished polygonal or rectangular tube has a precise contour which is desired; undesired outwardly bulging sides are no longer present. Preferably, the invention is so carried out that the rolling unit, in the direction of advance of the tube has a straightening unit located downstream thereof and with which the welded tube is precisely straightened in its longitudinal direction in a manner known per se.

In that case, the barrel-shaped roller unit, considered in the direction of advance of the tube, can be arranged in the region of the straightening unit. Alternatively, it is also possible to locate this unit between the rolling unit and the straightening unit.

In accordance with a further especially preferred feature, it is provided that the barrel-shaped roller unit have means enabling it to be displaced in a direction traverse to the longitudinal direction of the tube so that it will exert no force or only minimal force on the tube which can tend to deflect the tube transversely to its longitudinal direction. The basis for this configuration is that the precision and efficiency of the straightening unit is enhanced when apart from the straightening forces, additional forces act upon the tube which is to be expected from the convex roller process. So that this process does not disturb the straightening process, the barrel roll or convex roll unit is arranged to "float" so that the barrel-shaped rolls can follow tube deflections with respect to the straightening of the rolls without applying any additional loading tending to deflect the tube.

Preferably, the means for guiding the convex roll unit comprises at least one drive unit with which the convex roll unit can be moved traversely to the longitudinal direction of the tube. Especially preferred is an arrangement where this means includes a control circuit comprised of at least one sensor, a controller and at least one drive unit.

The drive unit can be an electrical actuator, and especially one which has an electric motor and a transmission. The transmission can include a threaded spindle for linear movement of the rolls. Alternatively, the drive unit can also include a hydraulic actuating element, especially a piston and cylinder system. To optimize the rolling results of the convex roll process, adjusting means can be provided with which the radial spacing of the convex or barrel-shaped rolls can be adjusted.

Advantageously, the means for shifting the barrel-shaped roll unit shifts the rolls thereof relative to a barrel-shaped roll frame or roll stand which is fixed in location. To improve the production of a rectangular tube it is finally provided according to a further feature that the barrel-shaped roll unit have at least two roll pairs whose axes are rotated relative to one another at right angles for rolling a rectangular tube.

BRIEF DESCRIPTION OF THE DRAWING

In the drawing, examples of the invention are shown. The drawing shows.

SPECIFIC DESCRIPTION

Figure 1:
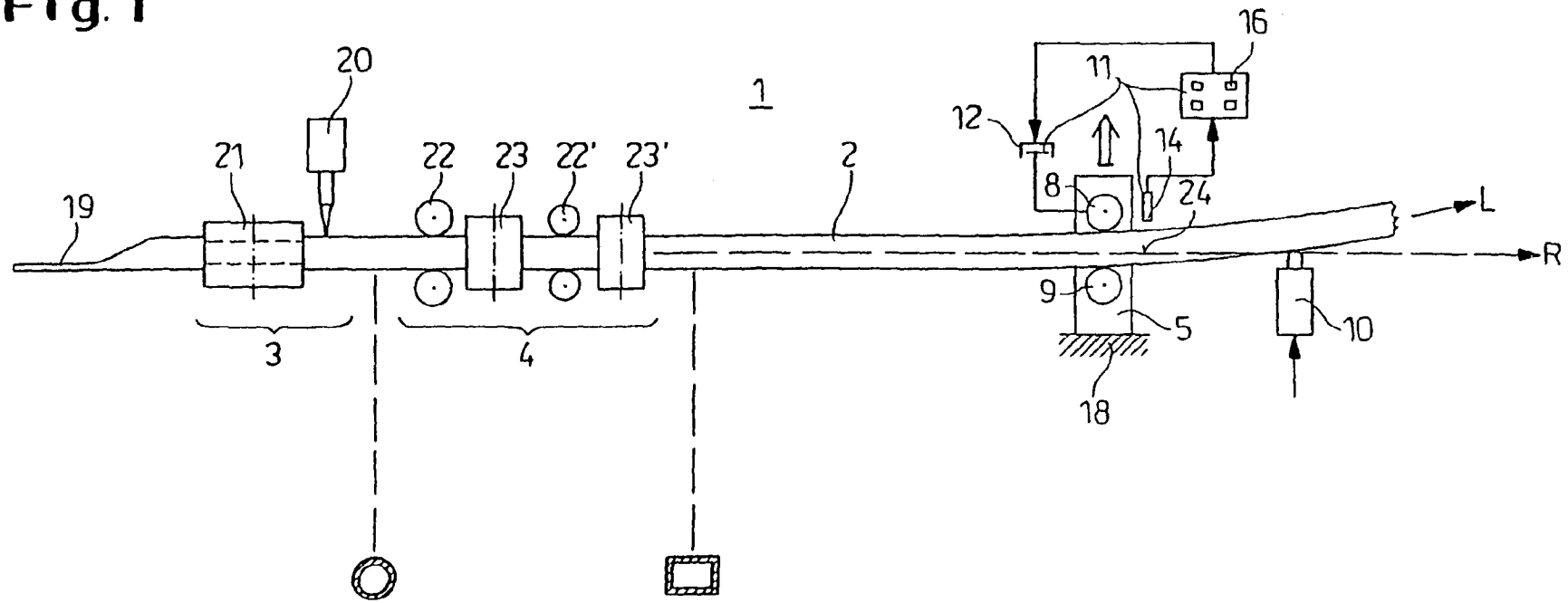
FIG. 1 a schematic view of the configuration of an apparatus for producing a rectangular tube.

In FIG. 1 the configuration of the apparatus 1 has been shown diagrammatically for the fabrication of a rectangular tube 2. The apparatus 1 is traversed from the left in the travel direction R by a flat metal strip 19. The latter is bent into a circular cross section tube in a known manner not illustrated in greater detail, and is welded in the tube-welding unit 3. That means that the metal strip which is bent into a tube is welded at the indicated welding location by a welding device 20 which has only been illustrated very schematically. During the welding process, the tube 2 is guided by rolls 21.

At the end of the tube-welding unit 3, there appears the finished circular cross section tube 2 as has been indicated diagrammatically in FIG. 1. This tube 2 is then to be reshaped into a rectangular tube. For this purpose, the rolling unit 4 is provided and is comprised of a plurality—in FIG. 1, two—sizing roll pairs or units 22, 22', 23, and 23' arranged one after the other in the travel direction R. The cooperating sizing roll pairs 22, 23, 22', 23' produce the desired rectangular profile as the tube reaches the end of the roll unit 4 as has also been schematically indicated in FIG. 1. In the embodiment illustrated, this is a consequence of the four roll pairs 22, 23, 22', 23' which are respectfully offset through 90° with respect to one another.

As a consequence of the stresses which arise in the welding process and the preforming process in the tube 2, the latter is not initially straight along the longitudinal direction L. As a consequence, a straightening process follows in which the tube is straightened. In FIG. 1, this has been shown only highly diagrammatically. As indicated: the straightening unit 10 comprises primarily an element which can exert a force upon the tube which is largely perpendicular to the longitudinal axis L of the tube 2. As can be seen from FIG. 1, the tube 2 is thereby deflected perpendicularly to its travel direction R. Since the tube 2 is held by the roll pairs 22 through 23' (considered with respect to the travel direction R) of the sizing frame, deflection of the tube 2 by the straightening unit 10 induces a bending deformation in the tube 2 which counteracts the bend already present in the tube.

The net result is that the tube is "bent straight". The straightening process is carried out in two axes which are perpendicular to the longitudinal direction L of the tube 2 (in FIG. 1 only the bending about one axis has been illustrated). Furthermore, the straightening is effected automatically and no more detailed description is thus included in FIG. 1. The straightening processing corresponds to the general state of the art.

Figure 2:
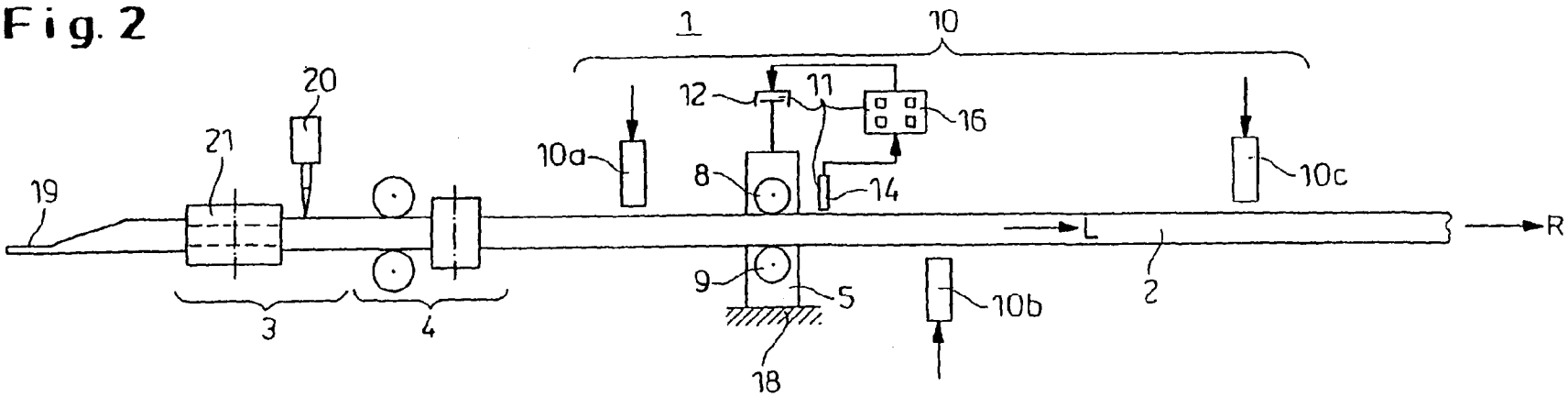
FIG. 2 a slightly modified configuration of the apparatus according to FIG. 1.

FIG. 2 schematically shows that the straightening unit 10 can also be comprised of a multiplicity of pressure elements 10*a*, 10*b*, 10*c* which exert forces perpendicular to the ideal longitudinal axis L upon the tube 2. The forces exerted by the pressure elements 10*a*, 10*b*, 10*c* are schematically indicated by arrows. Again, the bending has been illustrated about only one axis; exactly in the same manner the tube 2 can also be bent about at axis perpendicular to the first mentioned axis and therefore also straightened in this axis.

To counteract the tendency of the rectangular tube to bulge outwardly at the tube sides 6 and 7 (see FIG. 3), a barrel-shaped roll unit 5 is provided according to the invention.

This roll unit 5 according to FIG. 1 is arranged between the roll unit 4 and the straightening unit 10. According to FIG. 2, however, the barrel-shaped roll unit 5 can also be disposed proximal to the straightening unit 10.

The barrel-shaped roll unit 5 has two barrel-shaped rolls 8 and 9, each of which has a crowned convex shape. In traversing the barrel-shaped roll unit 5, the tube sides 6 and 7 are rolled into concave configurations (see FIGS. 3 and 4). The crowning of the barrel-shaped rolls 8, 9 is so selected, empirically or as a result of calculation, such that the concavity induced by the rolls 8, 9 in the tube 2 is sufficient to compensate for the outward bulging of the tube sides 6, 7. Overall, this gives a precise straight contour of the tube sides 6 and 7 as is desired.

To prevent the straightening process by means of the straightening unit 10 from being effected by the barrel roll process and the forces which are applied thereby, the barrel-shaped rolls 8, 9 are mounted to "float" transversely of the longitudinal axis L of the tube. As a result, these rolls 8 and 9 apply no net forces perpendicular to the longitudinal axis L of the tube 2.

For this purpose, means 11 are provided for guiding the barrel-shaped roll unit 5 perpendicularly to the longitudinal axis L of the tube 2. Such means can include a sensor 14 for detecting the actual (vertical) deflection of the tube 2 from the ideal line 24 (see FIG. 1) as well as a drive unit 12 for vertically displacing the barrel-shaped rolls 8, 9. Sensor 14 and drive unit 12 are connected together via a control 16. Should the sensor 14 detect a deflection of the tube 2 from the ideal line 24 (FIG. 1), the controller 11 will cause a vertical movement of the barrel-shaped rolls 8, 9, relative to its stationary barrel roll frame or stand 18 so that the rolls 8, 9 cannot transmit forces perpendicular to the longitudinal axis L to the tube 2. The straightening process thus operates efficiently and without falsification.

Figure 3:
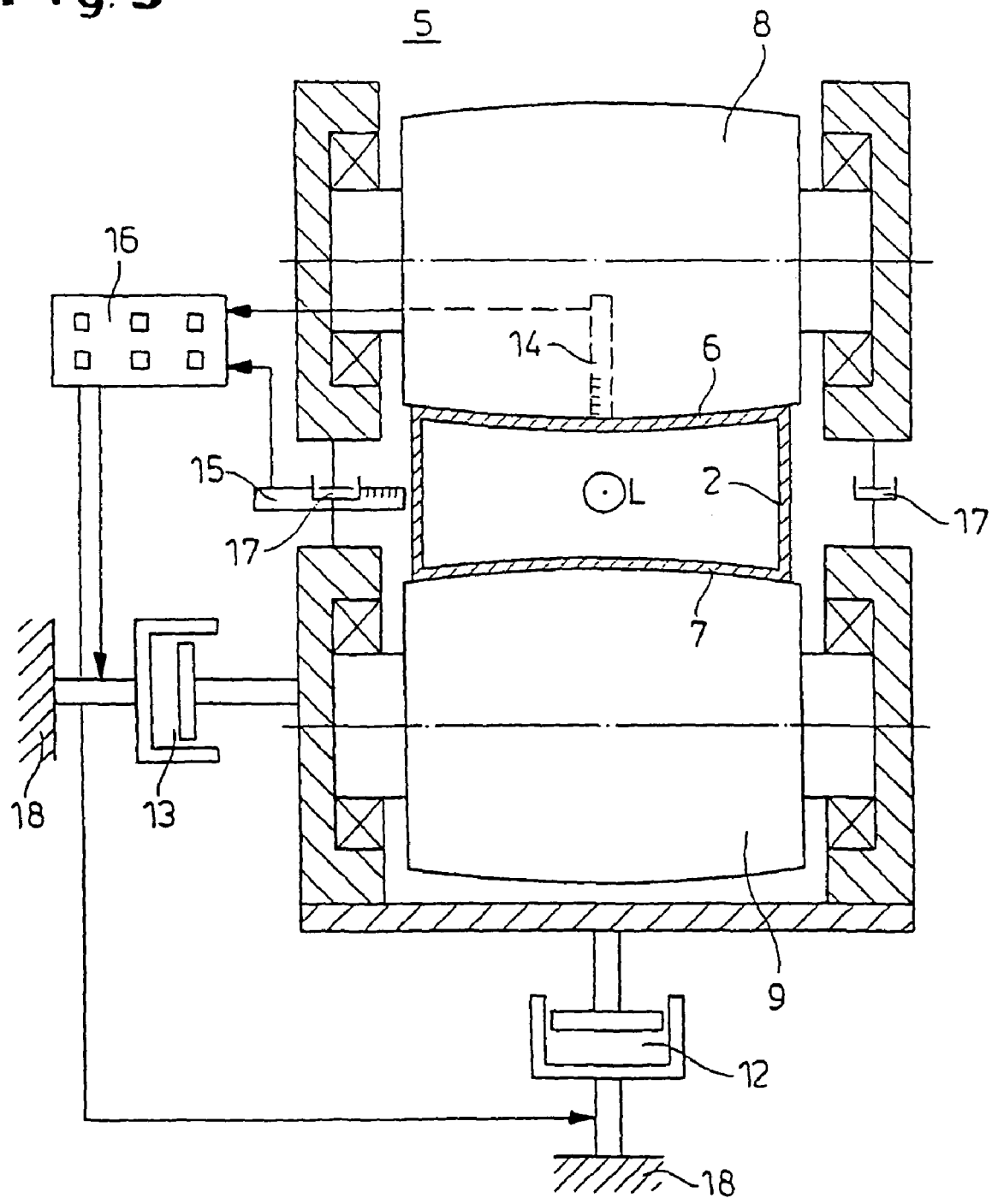
FIG. 3 a section through the barrel-shaped roll unit as seen in the direction of advance of the tube and FIG. 4 an alternative configuration to FIG. 3.

As is to be seen from FIG. 3, the movement of the barrel-shaped rolls 8, 9 is effected in two axes:

Not only is a sensor 14 provided for detecting the vertical deflection of the tube 2 but there is also a sensor 15 for detecting horizontal deflection. The control 16 regulates two drives 12 and 13 based upon the values detected by the sensors 14 and 15 so that the barrel-shaped rolls 8, 9 are shifted both vertically and horizontally based upon such deflections.

The forces applied by the barrel-shaped rolls 8, 9 are determined by the setting of an adjusting means 17 (see FIG. 3) which positions the two rolls 8 and 9 radially relative to one another.

Basically the longer tube sides have the greater tendency in the production of rectangular tubes to bulge outwardly. Nevertheless the shorter sides of the tube also can bulge outwardly.

Figure 4:
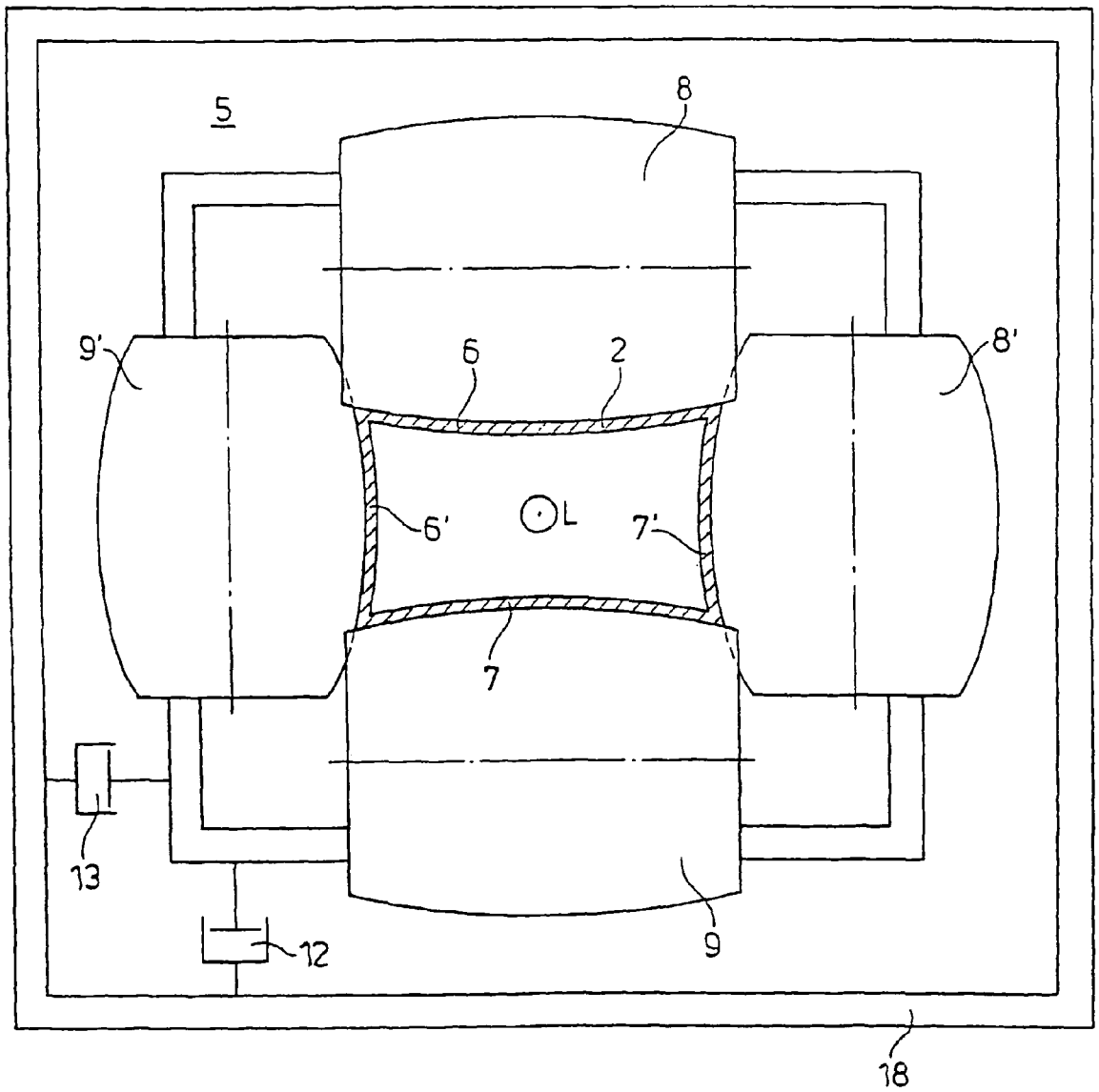

In the embodiment of FIG. 4, it can be seen that a barrel-shaped rolling of the rectangular tube can also be effected on all four sides 6, 6', 7, 7' of the tube 2.

The tube 2 in the illustrated case is thus contacted by a total of four barrel-shaped rolls 8, 9 and 8', 9' so that all tube sides 6, 7 and 6', 7' are rolled with a transversely outwardly concave curvature. It has been shown further schematically that the barrel-shaped rolls 8, 9, 8', 9' are adjusted relatively to the stationary barrel roll frame or barrel roll stand 18 in accordance with the actual tube deflection.

The invention claimed is:

1. An apparatus for producing a tube of polygonal cross section from a flat strip, the apparatus comprising:

tube-shaping and -welding means for bending the strip into a generally circular-section tube, welding edges of the strip together at a seam, and advancing the tube downstream in a travel direction;

means including a first roll unit downstream of the tube-shaping and -welding means for rolling the circular-section tube and transforming it into a tube of generally polygonal section with a plurality of pairs of opposite and substantially parallel flat sides;

means including a second roll unit having a plurality of pairs of barrel-shaped rolls downstream of the first roll unit, each barrel roll pressing against and inwardly bending a respective one of the opposite flat sides of the polygonal-section tube each barrel roll bearing on the respective side in a direction transverse to the respective side and to the travel direction; and respective guide means supporting each of the pairs of barrel rolls for floating free movement transversely of the direction and generally parallel to the respective side so that the barrel-shaped rolls exert substantially no transverse bending stress on the travel polygonal-section tube and can follow transverse movement of the tube and for shifting the respective barrel rolls in a direction transverse to the direction such that the barrel rolls do not exert any net force or only a minimum net force upon the tube.

2. The apparatus defined in claim 1, further comprising means downstream of the first roll unit for bearing transversely of the direction against the tube and thereby straightening the tube.

3. The apparatus defined in claim 2 wherein the straightening means is downstream of the second roll unit.

4. The apparatus defined in claim 3 wherein the straightening means has a part between the first and second roll units and a part downstream of the second roll unit.

5. The apparatus defined in claim 1 wherein the means for shifting the barrel rolls has at least one drive means for shifting the pairs of barrel rolls parallel and perpendicular to the respective sides with both rolls of each pair held at a constant spacing transversely of the direction.

6. The apparatus defined in claim 1 wherein the barrel-roll shifting means has control means including at least one sensor for detecting deviation of the polygonal-section tube.

7. The apparatus defined in claim 5 wherein the drive means includes an electrical actuator.

8. The apparatus defined in claim 7 wherein the electrical actuator is an electrical motor, and the drive means further comprises a transmission operatively connected between the electrical motor and the barrel rolls.

9. The apparatus defined in claim 8 wherein the transmission has a threaded spindle for linear movement for the barrel rolls.

10. The apparatus defined in claim 5 wherein the drive means includes a hydraulic actuator.

11. The apparatus defined in claim 10 wherein the hydraulic actuator is a piston-cylinder system.

12. The apparatus defined in claim 1, further comprising adjusting means for varying a radial spacing of the barrel rolls transversely of the direction.

13. The apparatus defined in claim 5 wherein the second roll unit includes a respective fixed frame holding each of the pairs of barrel rolls, the guide means including means for shifting the respective pairs of barrel rolls relative to the respective fixed frame.

14. The apparatus defined in claim 1 wherein the second roll unit has at least two pairs of barrel rolls whose axes are offset from one another through 90° for rolling of a rectangular-section tube.

15. An apparatus for producing a tube of polygonal cross section from a flat strip, the apparatus comprising:

tube-shaping and -welding means for bending the strip into a generally circular-section tube, welding edges of the strip together at a seam, and advancing the tube downstream in a travel direction;

means including a first roll unit downstream of the tube-shaping and -welding means for rolling the circular-section tube and transforming it into a tube of generally polygonal section with a plurality of pairs of parallel and flat opposite sides;

means including a second roll unit having a plurality of pairs of barrel-shaped rolls downstream of the first roll unit, each barrel roll pressing against and inwardly bending a respective one of the opposite flat sides of the polygonal-section tube each barrel roll bearing on the respective side in a direction transverse to the respective side and to the travel direction;

drive means for shifting the barrel rolls transversely of the direction and parallel to the respective sides;

sensor means for detecting a transverse position of the polygonal-section tube at the second roll unit; and control means connected between the drive means and the sensor means for operating the drive means to shift the barrel rolls transversely of the direction and parallel to the respective sides in accordance with any transverse shifting of the polygonal-section tube from an ideal straight center position so that the barrel rolls follow transverse movement of the tube and exert substantially no transverse force on the tube.

* * * * *